US010901346B2

(12) United States Patent
Ogishima

(10) Patent No.: US 10,901,346 B2
(45) Date of Patent: Jan. 26, 2021

(54) ROLL AND IMAGE FORMING APPARATUS

(71) Applicant: FUJI XEROX CO., LTD., Tokyo (JP)

(72) Inventor: Kazuya Ogishima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/514,353

(22) Filed: Jul. 17, 2019

(65) Prior Publication Data

US 2020/0310301 A1 Oct. 1, 2020

(30) Foreign Application Priority Data

Mar. 29, 2019 (JP) ..... 2019-068142

(51) Int. Cl.
*G03G 15/16* (2006.01)
*G03G 21/16* (2006.01)

(52) U.S. Cl.
CPC ..... *G03G 15/162* (2013.01); *G03G 21/168* (2013.01); *G03G 21/1647* (2013.01)

(58) Field of Classification Search
CPC ..... G03G 15/162; G03G 21/1647; G03G 21/168; G03G 15/168; G03G 2215/1614; G03G 15/0233; G03G 15/1685
See application file for complete search history.

(56) References Cited

U.S. PATENT DOCUMENTS 6,283,903 B1 * 9/2001 Onuki ..... G03G 15/0233 492/53
10,234,794 B2 3/2019 Imai et al.
2010/0135688 A1 * 6/2010 Sohn ..... G03G 15/206 399/90
2017/0168429 A1 * 6/2017 Imai ..... G03G 15/1685

FOREIGN PATENT DOCUMENTS

JP 2005-233991 A 9/2005
JP 2017-009985 A 1/2017

* cited by examiner

*Primary Examiner* — Sandra Brase
(74) *Attorney, Agent, or Firm* — Sughrue Mion, PLLC

(57) ABSTRACT

A roll includes an electrically-conductive shaft; an elastic layer provided on the shaft; and a non-electrically-conductive annular unit that is attached to at least one of ends of the shaft that protrude from end surfaces of the elastic layer in a shaft direction while being in contact with the end surface of the elastic layer. A fixing part that fixes an attachment position of the annular unit in the shaft direction is provided on a part of the ends of the shaft to which the annular unit is attached, and a fixed part fixed by the fixing part of the shaft is provided on a part of an inner circumferential surface of the annular unit in the shaft direction.

20 Claims, 15 Drawing Sheets

ROLL AND IMAGE FORMING APPARATUS

CROSS-REFERENCE TO RELATED APPLICATIONS

This application is based on and claims priority under 35 USC 119 from Japanese Patent Application No. 2019-068142 filed Mar. 29, 2019.

BACKGROUND

(i) Technical Field

The present disclosure relates to a roll and an image forming apparatus.

(ii) Related Art

Conventionally, the technique described in Japanese Unexamined Patent Application Publication No. 2017-9985 is known as a technique concerning a roll (roller) or the like in which leakage is hard to occur even upon application of a high voltage.

Japanese Unexamined Patent Application Publication No. 2017-9985 describes a roller member and an image forming apparatus using the roller member as a transfer roller or a transfer opposing roller. The roller member has an elastic layer on an outer circumferential surface of a cored bar that has a protruding part protruding from a range where the elastic layer is provided toward an end in an axial direction and a non-electrically-conductive member made of a non-electrically-conductive material and provided on the protruding part so as to cut into an end surface of the elastic layer at an end in the axial direction.

SUMMARY

Aspects of non-limiting embodiments of the present disclosure relate to providing a roll and an image forming apparatus using the roll. The roll is configured such that at least an elastic layer is provided on an electrically-conductive shaft to which a voltage that can cause discharge can be supplied and a non-electrically-conductive annular unit is attached to an end of the shaft that protrudes from an end of the elastic layer in a shaft direction while being in contact with an end surface of the elastic layer. The roll can suppress occurrence of discharge through a gap that occurs between the annular unit and the elastic layer due to a factor such as passage of time as compared with a case where a fixing part is not provided on a part of the shaft to which the annular unit is attached and a fixed part fixed by the fixing unit is not provided on the annular unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a roll including an electrically-conductive shaft; an elastic layer provided on the shaft; and a non-electrically-conductive annular unit that is attached to at least one of ends of the shaft that protrude from end surfaces of the elastic layer in a shaft direction while being in contact with the end surface of the elastic layer, wherein a fixing part that fixes an attachment position of the annular unit in the shaft direction is provided on a part of the ends of the shaft to which the annular unit is attached, and a fixed part fixed by the fixing part of the shaft is provided on a part of an inner circumferential surface of the annular unit in the shaft direction.

BRIEF DESCRIPTION OF THE DRAWINGS

Exemplary embodiments of the present disclosure will be described in detail based on the following figures, wherein:

FIGS. 10A and 10B are cross-sectional views illustrating a configuration of one end of a second transfer roll according to a second exemplary embodiment;

FIG. 12A is a schematic view illustrating one end of a shaft in the second transfer roll, and FIG. 12B is a schematic cross-sectional view illustrating an annular member in the second transfer roll;

DETAILED DESCRIPTION

Exemplary embodiments of the present disclosure are described with reference to the drawings.

First Exemplary Embodiment

Figure 1:
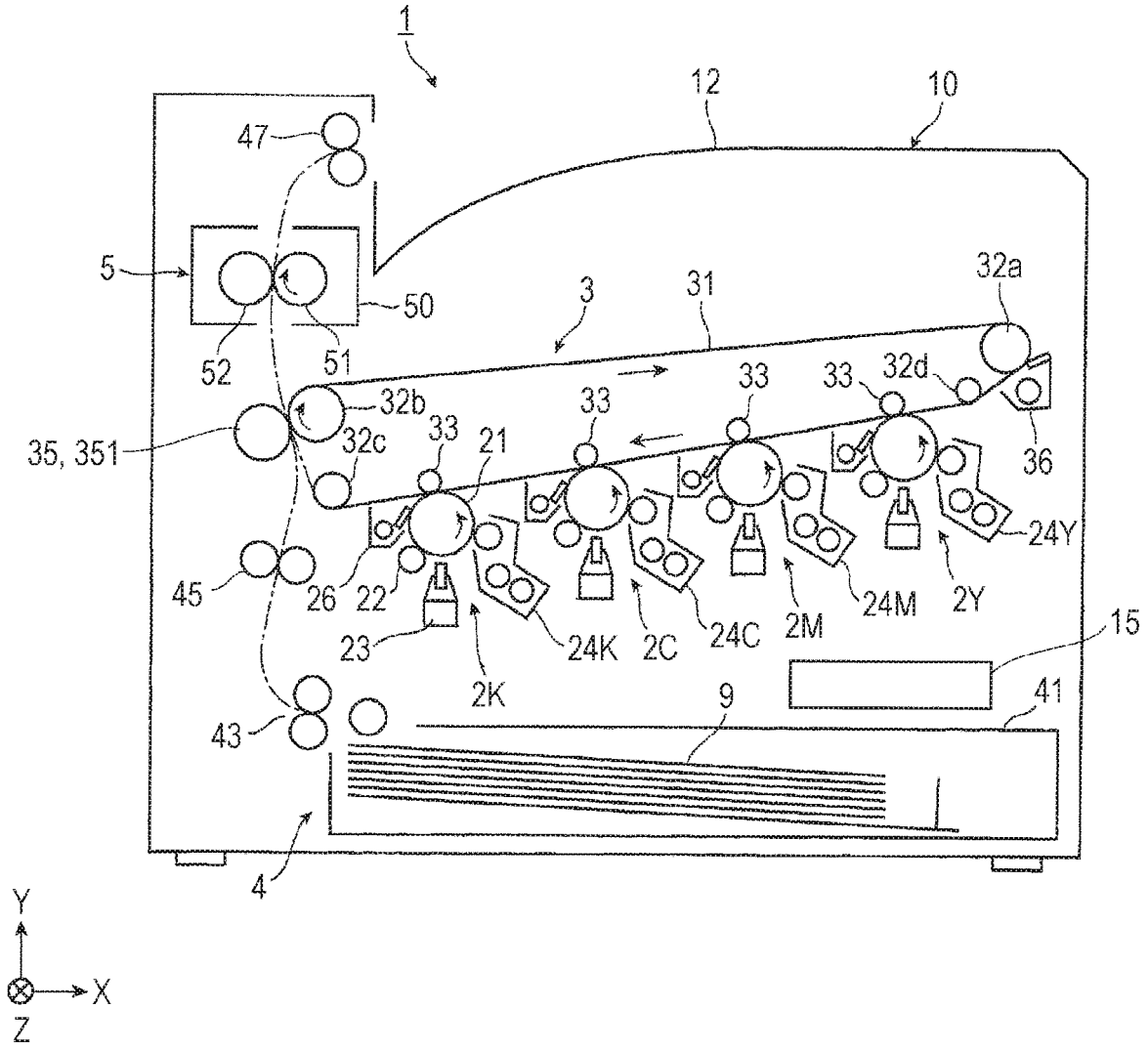
FIG. 1 is a schematic view illustrating a configuration of an image forming apparatus according to a first exemplary embodiment.

FIG. 1 illustrates an image forming apparatus 1 according to a first exemplary embodiment. Arrows X, Y, and Z in FIG. 1 and other drawings indicate width, height, and depth directions assumed in the drawings. The circle in a part where arrows X and Y intersect in FIGS. 1 and 2 and other drawings indicate that the direction indicated by arrow Z points downward perpendicularly to the drawings.

Image Forming Apparatus

The image forming apparatus 1 is an apparatus that forms an image made of toner serving as a developer on a sheet of paper 9 that is an example of a recording medium by an image formation method such as an electrophotographic system. This image forming apparatus 1 is, for example, a printer that forms an image corresponding to image information supplied from an external device such as an information terminal device or an image reading device.

As illustrated in FIG. 1, the image forming apparatus 1 includes, in an internal space of a housing 10 that is an example of an apparatus body, an image formation unit 2 that forms a toner image that is an unfixed image, an intermediate transfer unit 3 that second-transfers the toner image formed by the image formation unit 2 onto the sheet of paper 9 after temporarily holding and transferring the toner image, a paper feeding unit 4 that contains therein the sheet of paper 9 to be supplied to a position of second transfer of the intermediate transfer unit 3 and delivers the sheet of paper 9 out of the paper feeding unit 4, and a fixing unit 5 that fixes the toner image that has been second-transferred by the intermediate transfer unit 3 onto the sheet of paper 9.

The housing 10 is a structured object that is assembled to required structure and shape by using various materials such as support members and exterior materials. The housing 10 has, on a part of an upper surface part, a paper output containing unit 12 in which the sheets of paper 9 discharged after image formation are contained so as to be stacked on one another. The line with alternate long and short dashes in FIG. 1 indicates a major path along which the sheet of paper 9 is transported in the housing 10.

The image formation unit 2 is, for example, constituted by four image formation devices 2Y, 2M, 2C, and 2K for exclusively forming toner images of four colors (yellow (Y), magenta (M), cyan (C), and black (K)), respectively. The four image formation devices 2 (Y, M, C, and K) according to the first exemplary embodiment are arranged so that an image formation device 2 closer to a right side is located higher in the housing 10 illustrated in FIG. 1.

Figure 2:
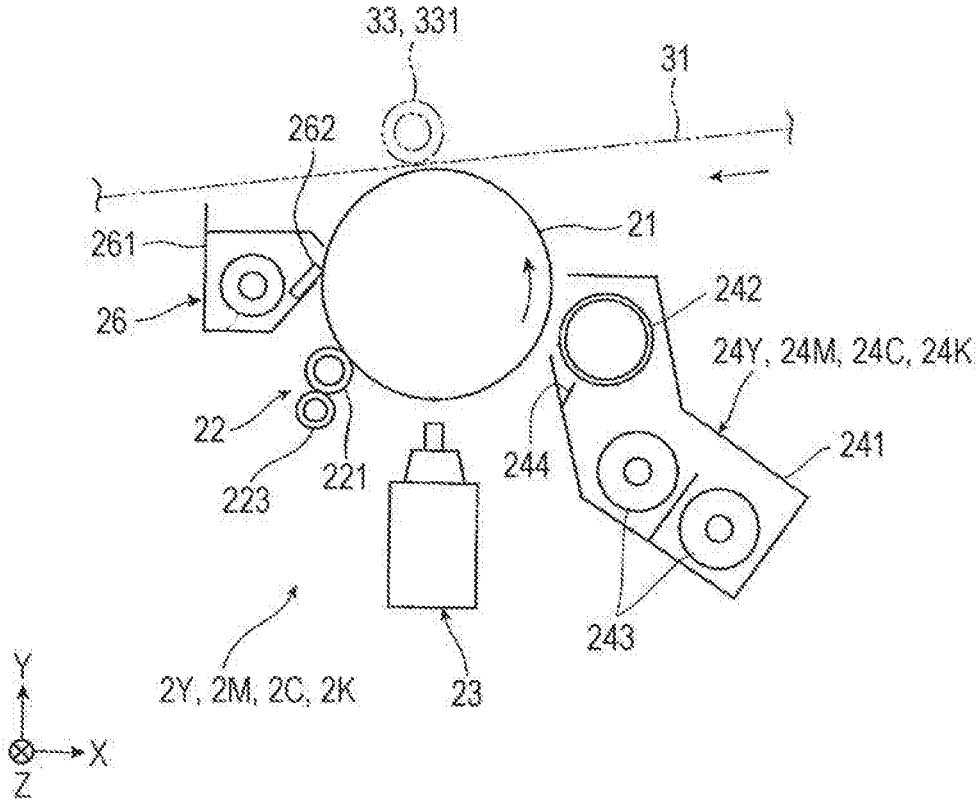
FIG. 2 is a schematic view illustrating a part (mainly an image formation device) of the image forming apparatus of FIG. 1.

Each of the four image formation devices 2 (Y, M, C, and K) has a photoconductor drum 21 that is an example of an image holding unit that rotates in a direction indicated by the arrow as illustrated in FIGS. 1 and 2.

In each of the image formation devices 2 (Y, M, C, and K), devices such as a charging device 22 that charges an image holding region of the photoconductor drum 21, an exposure device 23 that is an example of an exposure unit that forms an electrostatic latent image by performing exposure according to image information on the charged image holding region of the photoconductor drum 21, a developing device 24 (Y, M, C, or K) that forms a toner image by developing an electrostatic latent image formed on an image formation surface of the photoconductor drum 21 by using toner of a corresponding color, and a first cleaning device 26 that cleans the image formation surface of the photoconductor drum 21 are disposed around the photoconductor drum 21.

For convenience of description, in FIG. 1, all of reference signs 21 through 24 and 26 are described as for the image formation device 2K for black (K), and only a certain reference sign is described and remaining reference signs are omitted as for the image formation devices 2Y, 2M, and 2C for the other colors.

The charging device 22 is a contact-charging-type charging device that uses a charging roller 221 that is an example of a contact charging member and performs charging by using a required charging voltage supplied from a power feeding device 15 to the charging roller 221. In FIG. 2, a cleaning roll 223 that cleans a roll surface in contact with the charging roller 221 is further provided.

The developing devices 24 (Y, M, C, and K) have an almost same configuration except for a color (any of the four colors (Y, M, C, and K) of toner in a developer contained in a body (housing) 241. That is, as illustrated in FIG. 2, each of the developing devices 24 (Y, M, C, and K) is configured such that a development roller 242 that holds a developer and transports the developer by rotating so that the developer passes a developing-step region that faces the photoconductor drum 21, a stirring member 243 such as an auger that rotates to transport the developer to the development roller 242 while stirring the developer in the body 241, a layer thickness regulating member 244 that regulates an amount (thickness) of the developer held in the development roller 242, and the like are disposed in the body 241. The development roller 242 performs development by using a required voltage for development supplied from the power feeding device 15.

The intermediate transfer unit 3 is disposed above the image formation devices 2 (Y, M, C, and K) that serve as image formation unit 2 in the housing 10.

The intermediate transfer unit 3 is configured such that devices such as an intermediate transfer belt 31 that receives toner images formed in the image formation devices 2 (Y, M, C, and K) in first transfer and hold the toner images and then rotate to transport the toner images to a position of second transfer on the sheet of paper 9, a first transfer device 33 that first-transfers the toner images formed on the photoconductor drums 21 of the image formation devices 2 (Y, M, C, and K) onto an image holding region of an outer circumferential surface of the intermediate transfer belt 31, a second transfer device 35 that second-transfers the toner images on the intermediate transfer belt 31 onto the sheet of paper 9, and a second cleaning device 36 that cleans the outer circumferential surface of the intermediate transfer belt 31 are disposed.

The intermediate transfer belt 31 is suspended across plural support rolls 32*a* through 32*d* and rotates in a direction indicated by the arrow while sequentially passing the photoconductor drums 21 of the image formation devices 2 (Y, M, C, and K), the second transfer device 35, and the like. The support roll 32*a* is configured as a drive roll, and the support roll 32*b* is configured as a second transfer opposing roll.

As illustrated in FIGS. 1 and 2, the first transfer device 33 is a contact-transfer-type transfer device that performs first transfer by using a first transfer roll 331 that is an example of a contact transfer member by using a required voltage for first transfer supplied from the power feeding device 15 to the first transfer roll 331.

Figure 3:
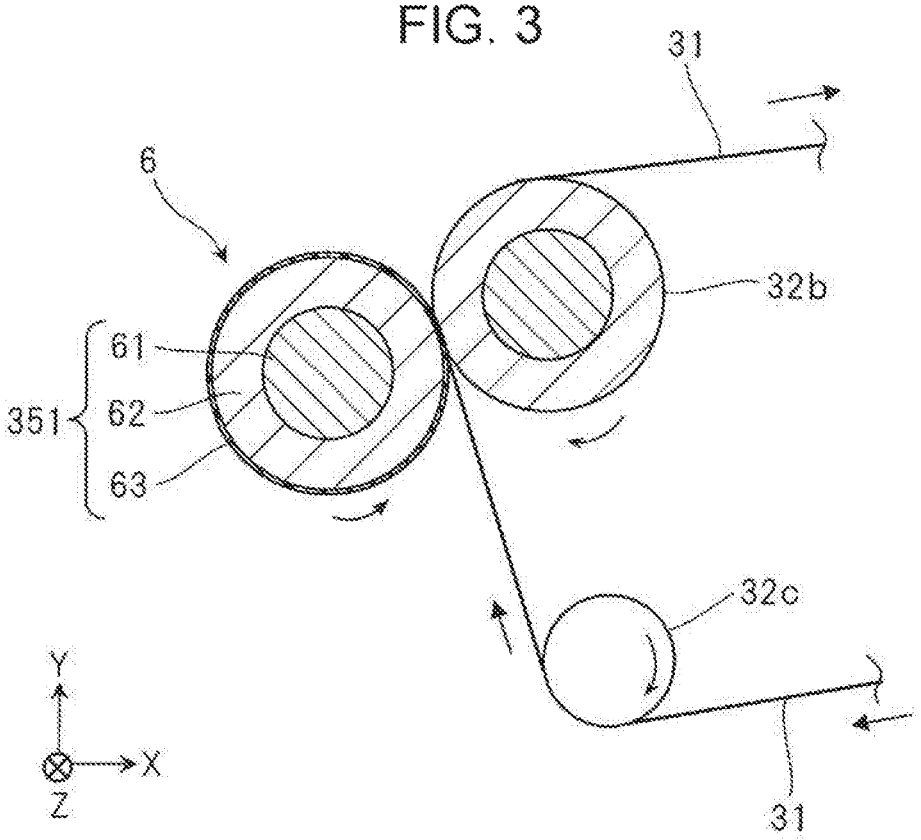
FIG. 3 is a schematic view illustrating another part (mainly a second transfer part) of the image forming apparatus of FIG. 1.

Furthermore, as illustrated in FIGS. 1 and 3, the second transfer device 35 is a contact-transfer-type transfer device that performs second transfer by using a second transfer roll 351 that is an example of a contact transfer member by using a required voltage for second transfer supplied from the power feeding device 15 to the second transfer roll 351.

The paper feeding unit 4 is configured such that devices such as a paper container 41 in which the sheet of paper 9 is contained and a delivery device 43 that delivers the sheet of paper 9 one by one out of the paper container 41 are disposed. The sheet of paper 9 delivered out of the paper feeding unit 4 is transported to a second transfer position between the intermediate transfer belt 31 and the second transfer device 35 in the intermediate transfer unit 3 through a paper feeding transport path constituted by a paper transport roll 45, a transport guide (not illustrated), and the like.

The fixing unit 5 is disposed above the second transfer position of the intermediate transfer unit 3. The fixing unit 5 is configured such that devices such as a rotating body for heating 51 and a rotating body for pressurizing 52 are disposed in in the internal space of a housing 50. The sheet of paper 9 delivered after fixation in the fixing unit 5 is transported to the paper output containing unit 12 through an exit path constituted by a paper transport roll 47, a transport guide (not illustrated), and the like.

Second Transfer Roll

The second transfer roll 351 is configured as an example of a roll 6 according to the present disclosure.

As illustrated in FIGS. 3 through 5 and other drawings, the second transfer roll 351 includes a shaft 61, an elastic layer 62 and a surface layer 63 that are provided on the shaft 61, and an annular member 64 that is an example of an annular unit that is attached to both ends 61*a* and 61*b* of the shaft 61 that protrude from end surfaces 62*e* of the elastic layer 62 in a shaft direction D while being in contact with the end surfaces 62*e* of the elastic layer 62.

Figure 4A:
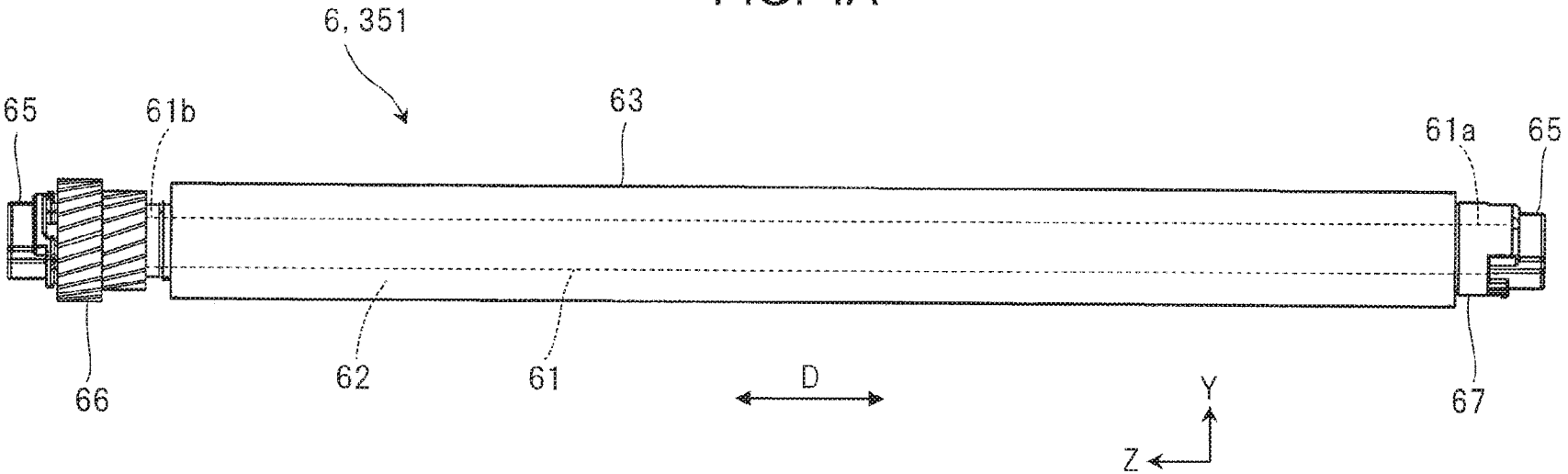
FIG. 4A is a schematic view illustrating a whole second transfer roll to which a roll according to the first exemplary embodiment has been applied.
Figure 4B:
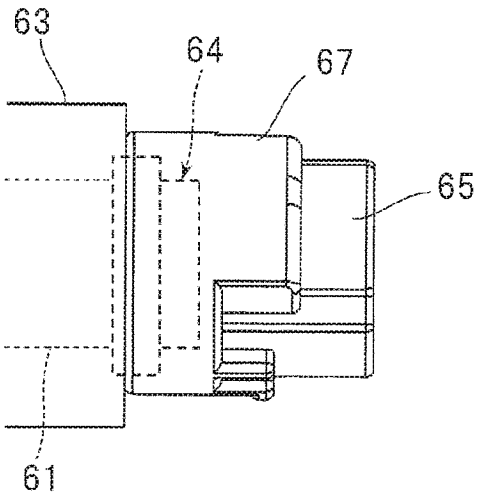
FIG. 4B is an enlarged schematic view illustrating one end of the roll of FIG. 4A.

In FIGS. 4A and 4B, a non-electrically-conductive holder 65 used to attach the whole second transfer roll 351 to an attachment part such as a support frame (not illustrated) while holding the ends 61*a* and 61*b* of the shaft 61 is illustrated. Furthermore, a two-step gear 66 that is constituted by a gear that receives rotational power transmitted to the second transfer roll 351 from a rotary drive device (not illustrated) and a relay gear that relays and transmits the rotational power to rotary components other than the second transfer roll 351 and a non-electrically-conductive cover 67 that that covers a gap between the holder 65 and the annular member (64) that will be described later are illustrated.

In each of the two holders 65, a shaft bearing that rotatably supports the end 61*a* or 61*b* of the shaft 61 is disposed. In the holder 65 on a side where the cover 67 is disposed, a power feeding member (not illustrated) that supplies a voltage for second transfer supplied from the power feeding device 15 while being in contact with the shaft 61 is disposed. The power feeding member makes contact with and is connected to a member for transmitting power from the power feeding device 15 when the second transfer roll 351 is attached.

The shaft 61 is a member having an almost columnar shape the whole of which has required diameter and length and is made of a material, such as stainless steel (SUS), having electrical conductivity.

Figure 6A:
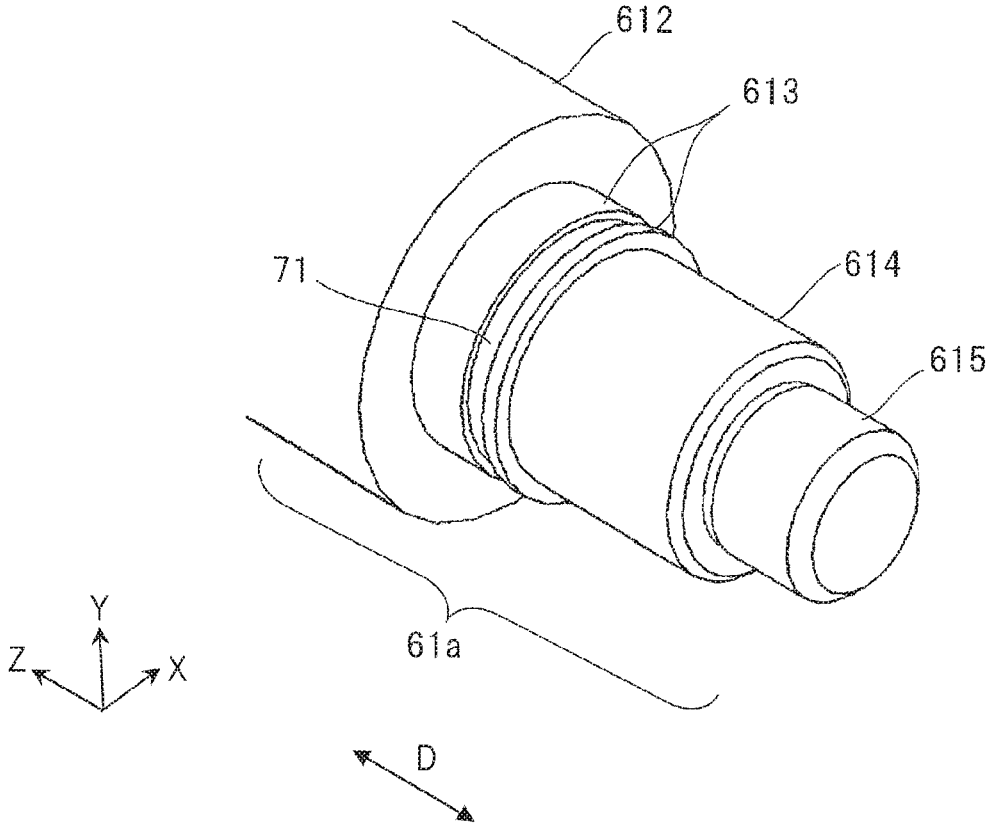
FIG. 6A is a perspective view illustrating one end of a shaft in the second transfer roll of FIGS. 5A and 5B.

As illustrated in FIG. 6A and other drawings, the shaft 61 according to the first exemplary embodiment is configured such that parts of the ends 61*a* and 61*b* to which the annular member 64 is attached are stepped parts each constituted by a large-diameter part 612 and a small-diameter part 613 that have different (large and small) external diameters. The large-diameter part 612 has the same diameter as a part where the elastic layer 62 is provided. The small-diameter part 613 is a part that has a smaller external diameter than the large-diameter part 612. In FIG. 6A, the elastic layer 62 and the surface layer 63 are omitted.

Figure 5A:
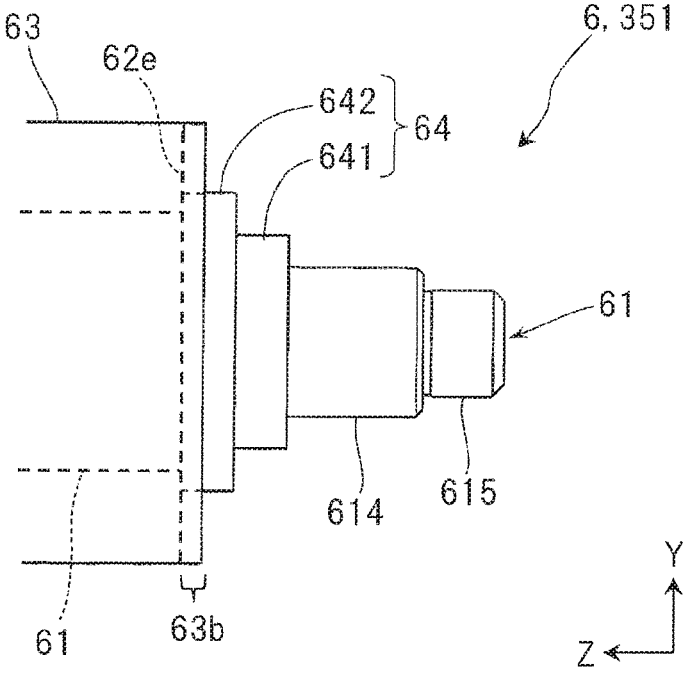
FIG. 5A is a schematic view illustrating a state where a holder and the like have been detached in one end of the second transfer roll of FIGS. 4A and 4B.
Figure 5B:
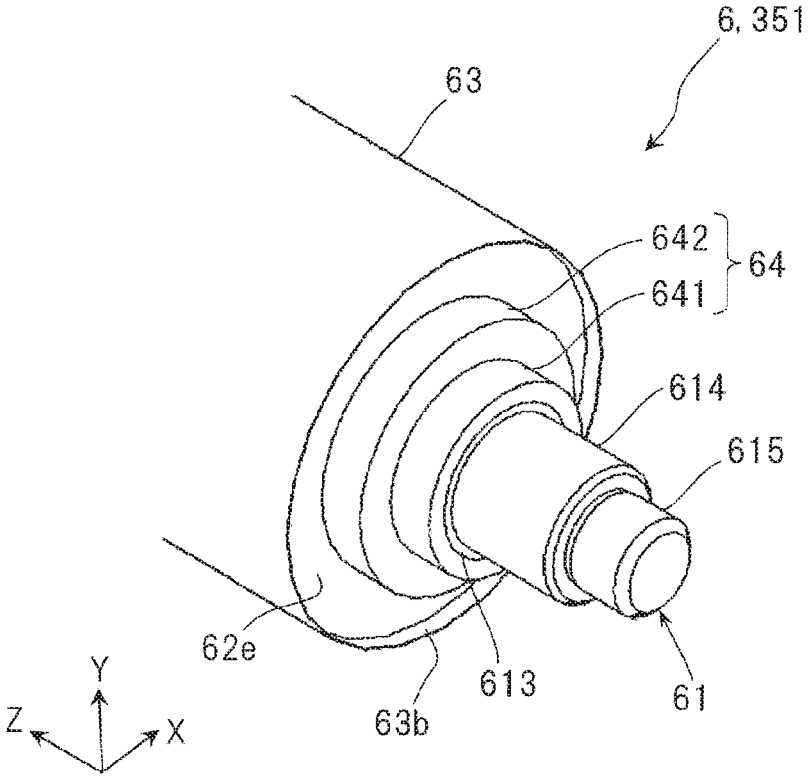
FIG. 5B is a perspective view illustrating one end of the roll of FIG. 5A.

As illustrated in FIGS. 5A, 5B, and 6A and other drawings, the shaft 61 further has, on an outer side of the small-diameter part 613, a second small-diameter part 614 that has a smaller external diameter than the small-diameter part 613 and a third small-diameter part 615 that has a smaller external diameter than the second small-diameter part 614. The second small-diameter part 614 and the third small-diameter part 615 are used for attachment of the holder 65 and attachment of the shaft bearing.

To the shaft 61, a voltage for second transfer of 5 kV to 7 kV is supplied through the power feeding member (not illustrated) provided in the holder 65 when second transfer is performed.

The elastic layer 62 is a layer that has a required thickness and is elastically deformable and is made of a material such as an electrically-conductive foam material (electrically-conductive foam ECO/NBR).

The elastic layer 62 according to the first exemplary embodiment is provided so that small portions of both ends of the large-diameter part 612 of the shaft 61 are left uncovered. Furthermore, the elastic layer 62 is configured so that a volume resistivity thereof is, for example, within a range of $10^6$ Ω·cm to $10^9$ Ω·cm.

The surface layer 63 is a surface layer for giving a required function such as release properties.

The surface layer 63 according to the first exemplary embodiment is configured as a release layer, made of a material such as polyimide, and covers an outer circumferential surface of the elastic layer 62. The surface layer 63 is configured so that a volume resistivity thereof is, for example, within a range of $10^8$ Ω·cm to $10^{12}$ Ω·cm.

As illustrated in FIGS. 5A and 5B and other drawings, the surface layer 63 projects from the ends 61*a* and 61*b* of the elastic layer 62 by a required length. In FIGS. 5A and 5B and other drawings, a projecting part 63*b* of the surface layer 63 is illustrated.

The annular member 64 is a non-electrically-conductive member (volume resistivity: $10^{15}$ Ω·cm or more) attached to the ends 61*a* and 61*b* of the shaft 61 that protrude from the end surfaces 62*e* of the elastic layer 62 while being in contact with the end surfaces 62*e* of the elastic layer 62 and is called a collar. The annular member 64 is formed to a required shape by using a material such as a polyacetal (POM) molding material (M90-44).

Figure 6B:
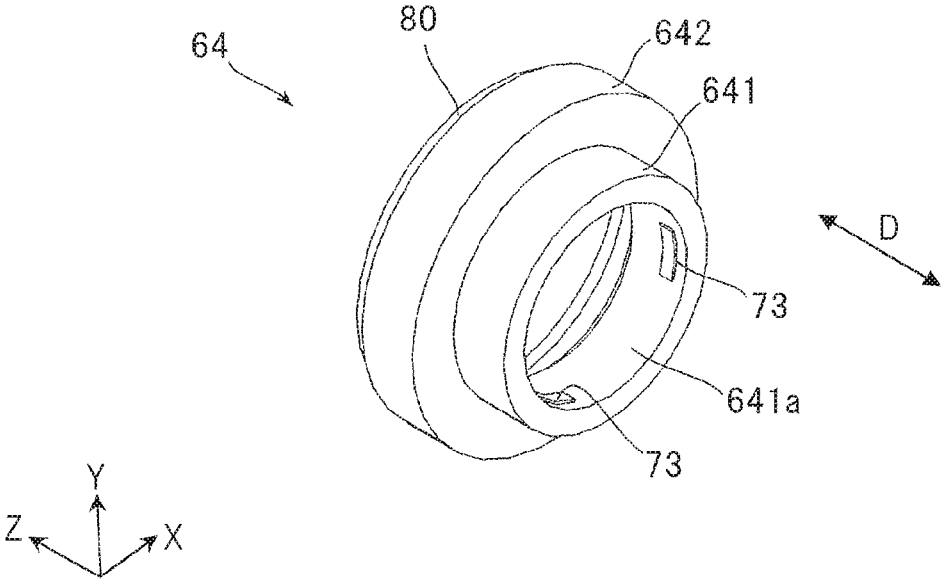
FIG. 6B is a perspective view illustrating an annular member in the second transfer roll of FIGS. 5A and 5B.
Figure 7A:
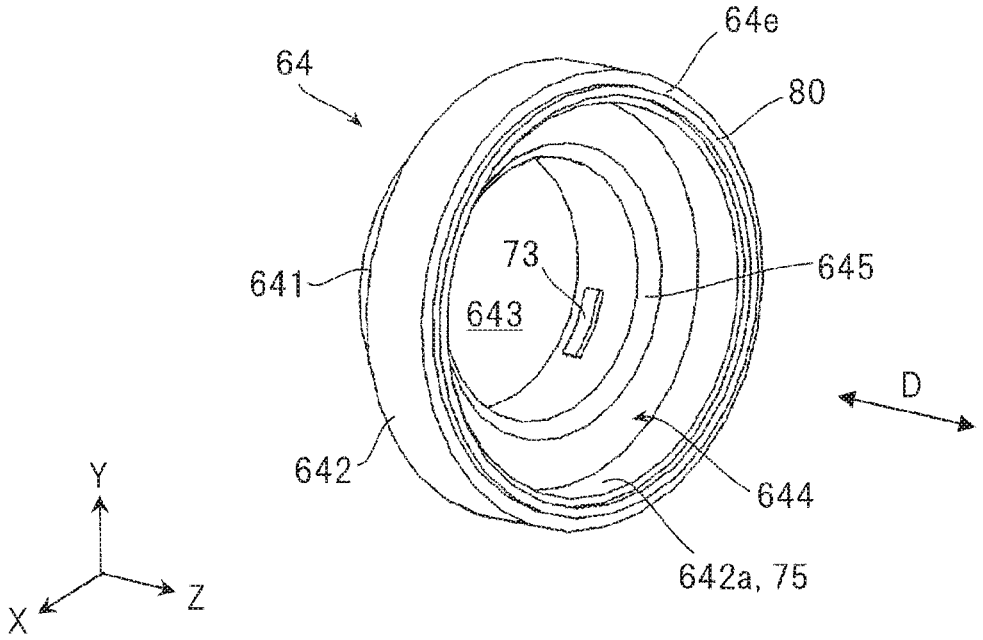
FIGS. 7A and 7B are schematic views illustrating states obtained when the annular member of FIG. 6B is viewed from different directions.
Figure 7B:
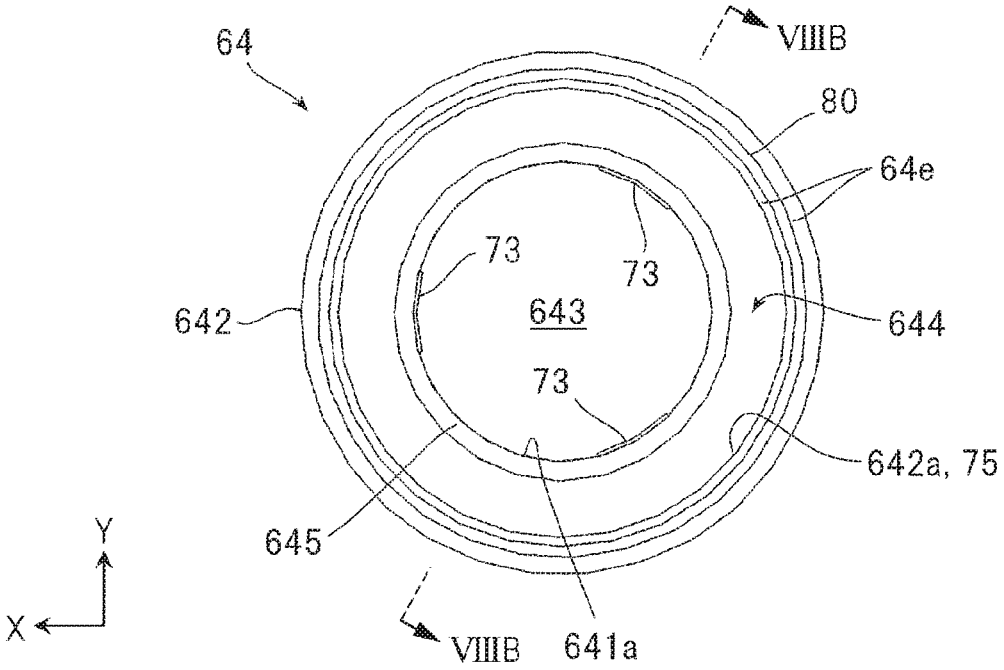

As illustrated in FIGS. 5B and 6B, the annular member 64 according to the first exemplary embodiment is configured as a two-step member having a small-diameter part 641 and a large-diameter part 642 that are fitted to and attached to the small-diameter part 613 and the large-diameter part 612 of the stepped part of the shaft 61, respectively. An attachment hole (a hollow space) 643 having a columnar shape of a small diameter to which the small-diameter part 613 of the shaft 61 can be fitted is formed inside the small-diameter part 641. An attachment hole (recess) 644 having a large diameter and recessed toward the small-diameter part 641 is formed inside the large-diameter part 642 so that the large-diameter part 612 of the shaft 61 can be fitted into the attachment hole 644. A boundary part between the attachment hole 643 having the small diameter and the attachment hole 644 having the large diameter is a tapered surface 645 that is a slope expending from the attachment hole 643 having the small diameter toward the attachment hole 644 having the large diameter as illustrated in FIGS. 7A and 7B.

Figure 15A:
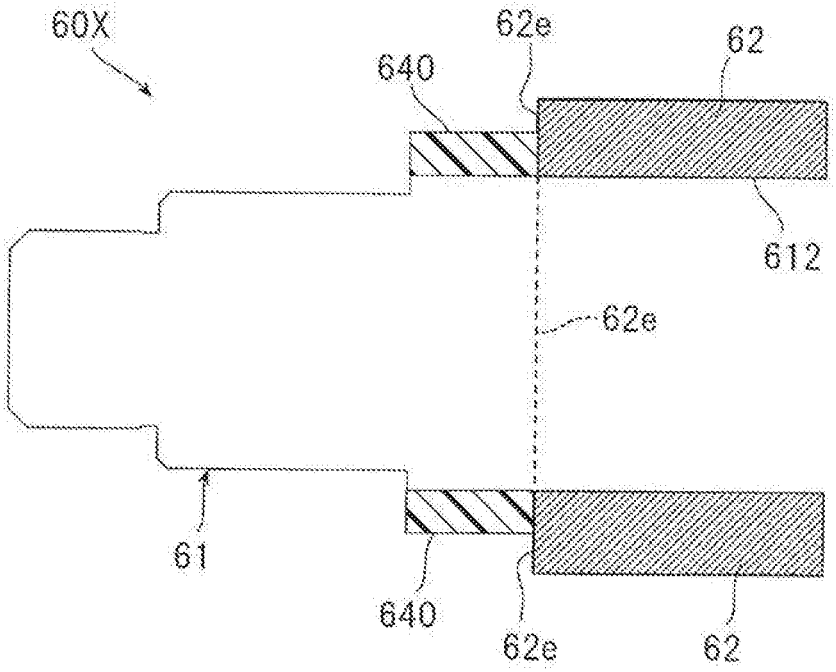
FIGS. 15A and 15B are schematic cross-sectional views illustrating a configuration of an annular member in a second transfer roll according to a first comparative example and a state during occurrence of discharge.

According to studies of the inventor of the present disclosure, it has been confirmed that the following troubles occur in a case where a roll 60X according to a first comparative example in which an annular member 640 for comparison that is different from the annular member 64 only in that the annular member 640 does not have a stepped shape is attached to an end of the shaft 61 while being in contact with the end surface 62*e* of the elastic layer 62 instead of the annular member 64 is applied as the second transfer roll 351 as illustrated in FIG. 15A. The annular member 640 is firmly fixed to one end of the shaft 61 by a method such as press fitting.

That is, in a case where the roll 60X according to the first comparative example is used as the second transfer roll 351 to which a voltage for second transfer of approximately 5 kV to 7 kV is supplied, discharge sometimes occurs after elapse of a certain period (e.g., 100 hours or longer). It is estimated that this discharge occurs from the shaft 61 of the roll 60X toward the intermediate transfer belt 31.

Figure 15B:
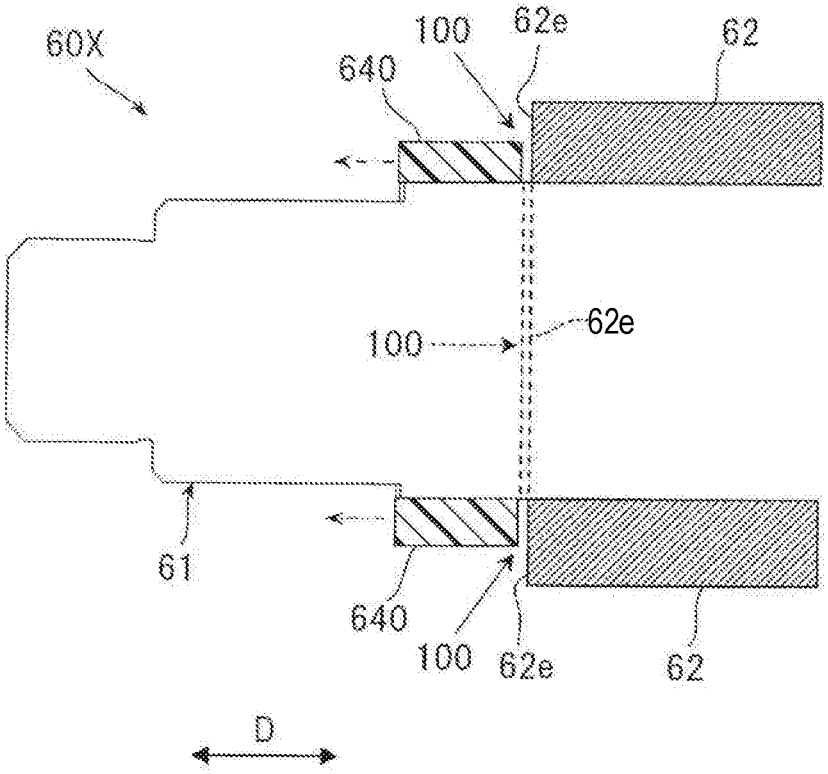

As a result of examination of the roll 60X that causes the discharge, it has been confirmed that a small gap 100 reaching the shaft 61 is present between the annular member 640 and the end surface 62*e* of the elastic layer 62 as illustrated in FIG. 15B. The gap 100 is considered to have occurred because the annular member 640 is slightly deviated in the shaft direction D from the end surface 62*e* of the elastic layer 62 as illustrated in FIG. 15B. This gap 100 occurs throughout an entire range in a circumferential direction of the annular member 640.

In view of this, in the roll 6 that serves as the second transfer roll 351, a fixing part 71 that fixes an attachment position of the annular member 64 in the shaft direction D is provided on parts of the ends 61*a* and 61*b* of the shaft 61 to which the annular member 64 is attached, and a fixed part 73 fixed by the fixing part 71 of the shaft 61 is provided on a part of an inner circumferential surface (614*a*) of the annular member 64 in the shaft direction D, as illustrated in FIGS. 6 through 9.

As illustrated in FIG. 6A and other drawings, since the part of the shaft 61 where the annular member 64 is attached is a stepped part constituted by the large-diameter part 612 and the small-diameter part 613, the fixing part 71 is provided on the small-diameter part 613 of the stepped part.

Figure 8A:
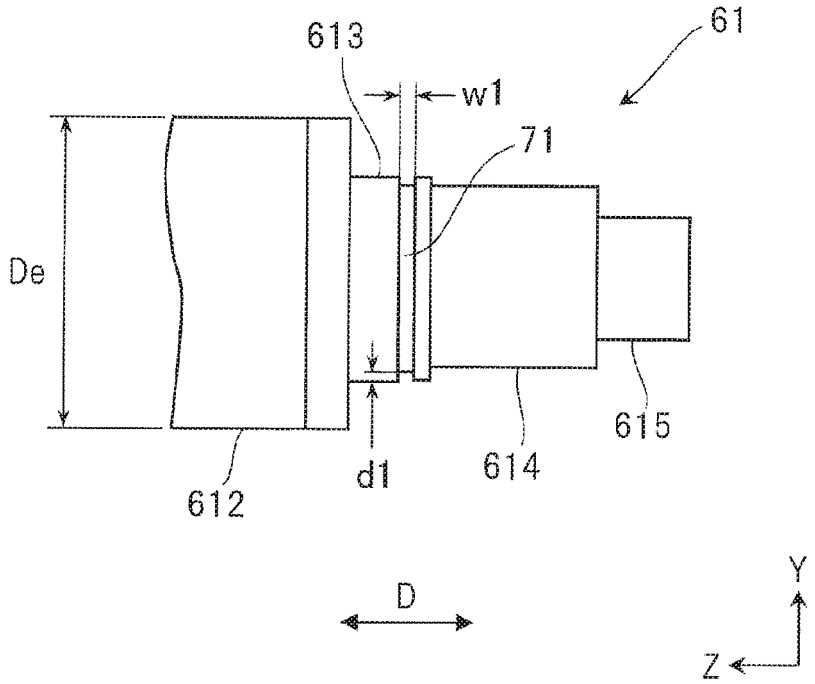
FIG. 8A is a schematic view illustrating one end of the shaft in the second transfer roll of FIGS. 5A and 5B.

As illustrated in FIGS. 6A and 8A and other drawings, the fixing part 71 according to the first exemplary embodiment is a groove (an example of a recess) continuous throughout an entire range in a circumferential direction of the small-diameter part 613 of the shaft 61. The circumferential direction is a direction that is almost orthogonal to (crosses at an angle of 90°±1°) the shaft direction D. The groove of the fixing part 71 is an annular groove that has an almost rectangular cross section and required width w1 and depth d1 and is continuous throughout the entire range in the circumferential direction of the small-diameter part 613.

Meanwhile, as illustrated in FIG. 6B and other drawings, the fixed part 73 is provided on an inner circumferential surface 641*a* of the attachment hole 643 having the small diameter in the small-diameter part 641 since the annular member 64 has a two-step shape having the small-diameter part 641 and the large-diameter part 642 and a part attached to the small-diameter part 613 of the shaft 61 on which the fixing part 71 is provided is the small-diameter part 641.

This fixed part 73 has a shape that is fitted into the groove of the fixing part 71 of the shaft 61 and is not displaced at least in the shaft direction D. Furthermore, the fixed part 73 is located so that the end surface 64*e* of the large-diameter part 642 of the annular member 64 is in contact with the end surface 62*e* of the elastic layer 62 in a case where the fixed part 73 is fitted into the groove of the fixing part 71 provided on the shaft 61.

As illustrated in FIGS. 6B, 7A, 7B, and 8B and other drawings, plural (three in this example) fixed parts 73 according to the first exemplary embodiment are provided at intervals in the circumferential direction of the inner circumferential surface 641*a* of the small-diameter part 641 of the annular member 64. Furthermore, each of the fixed parts 73 is a plate-shaped protrusion (an example of a raised part) that has required width w2 and height h1, is raised from the inner circumferential surface 641*a* of the small-diameter part 641, and extends so as to be curved in an arc shape having a required length m in the circumferential direction.

In this case, the width w2 of the fixed part 73 is very slightly smaller than the width w1 of the groove of the fixing part 71. The height h1 of the fixed part 73 is slightly lower than the depth d1 of the groove of the fixing part 71 and is, for example, approximately 0.01 mm to 0.06 mm. Furthermore, the length m of each fixed part 73 is shorter than ⅓ (e.g., approximately 1/18) of the circumferential length of the inner circumferential surface 641*a* since three fixed parts 73 are provided at intervals in the circumferential direction of the inner circumferential surface 641*a* of the small-diameter part 641.

Furthermore, in the roll 6 that serves as the second transfer roll 351 in the first exemplary embodiment, a part of the inner circumferential surface of the annular member 64 except for a part where the fixed parts 73 are provided is configured as a press-fitted part 75 that is press-fitted to the ends 61*a* and 61*b* of the shaft 61.

Since the fixed parts 73 are provided in a part of the small-diameter part 641 of the inner circumferential surface 641*a* along the circumferential direction, a part of the inner circumferential surface of the annular member 64 according to the first exemplary embodiment except for a part where the fixed parts 73 are provided is the inner circumferential surface 642*a* of the large-diameter part 642 that is not the inner circumferential surface 641*a* of the small-diameter part 641.

The press fitting means attaching the press-fitted part 75 of the annular member 64 to an attachment part of the shaft 61 by pressing the press-fitted part 75 onto the attachment part by application of pressure. Accordingly, as illustrated in FIGS. 8A and 8B, for example, the press-fitted part 75 is configured such that an inner diameter Di of the press-fitted large-diameter part 642 of the annular member 64 is the same as or very slightly smaller than an external diameter De of the large-diameter part 612 of the shaft 61 to which the press-fitted part 75 is attached, and the press-fitted part 75 is made of a material that can be deformed so that a diameter thereof temporarily expands without breaking the large-diameter part 642 and the like when certain force or larger force is applied to the annular member 64.

Figure 8B:
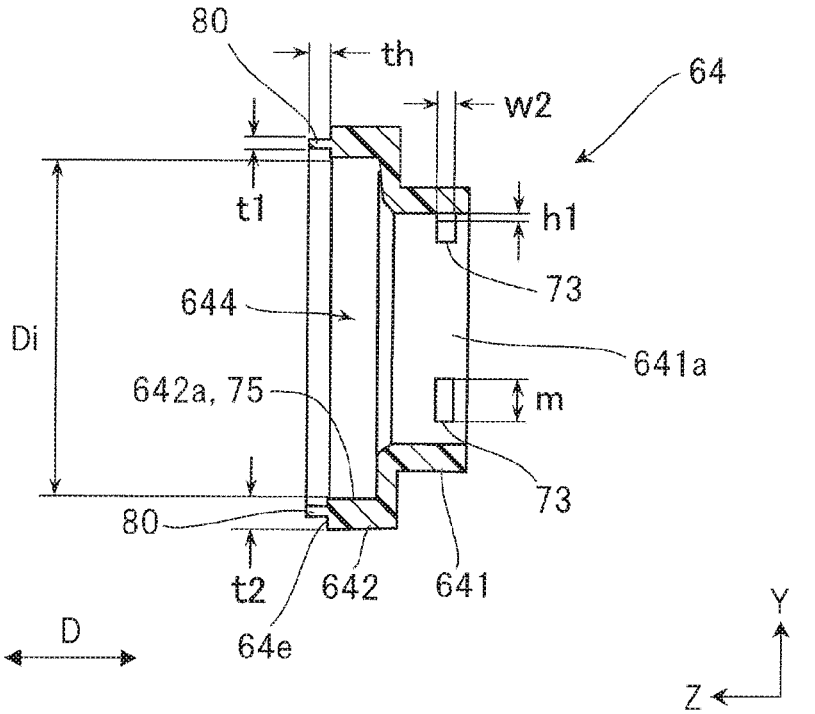
FIG. 8B is a schematic cross-sectional view of the annular member of FIG. 7B taken along line VIIIB-VIIIB.

Furthermore, in the roll 6 that serves as the second transfer roll 351 according to the first exemplary embodiment, a protruding part 80 that cuts into the end surface 62*e* of the elastic layer 62 is provided on the end surface 64*e* of the annular member 64 that makes contact with the elastic layer 62 as illustrated in FIGS. 7A, 7B, and 8B and other drawings.

As illustrated in FIG. 8B, the protruding part 80 according to the first exemplary embodiment protrudes almost in parallel with the shaft direction D from the end surface 64*e* of the large-diameter part 642 of the annular member 64 that makes contact with the end surface 62*e* of the elastic layer 62 and has a thickness t1 (<t2) smaller than a thickness t2 of the end surface 64*e* of the annular member 64. The thickness t1 of the protruding part 80 is desirably for example, smaller than ½ of the thickness t2 of the end surface 64*e* of the annular member 64.

Figure 9A:
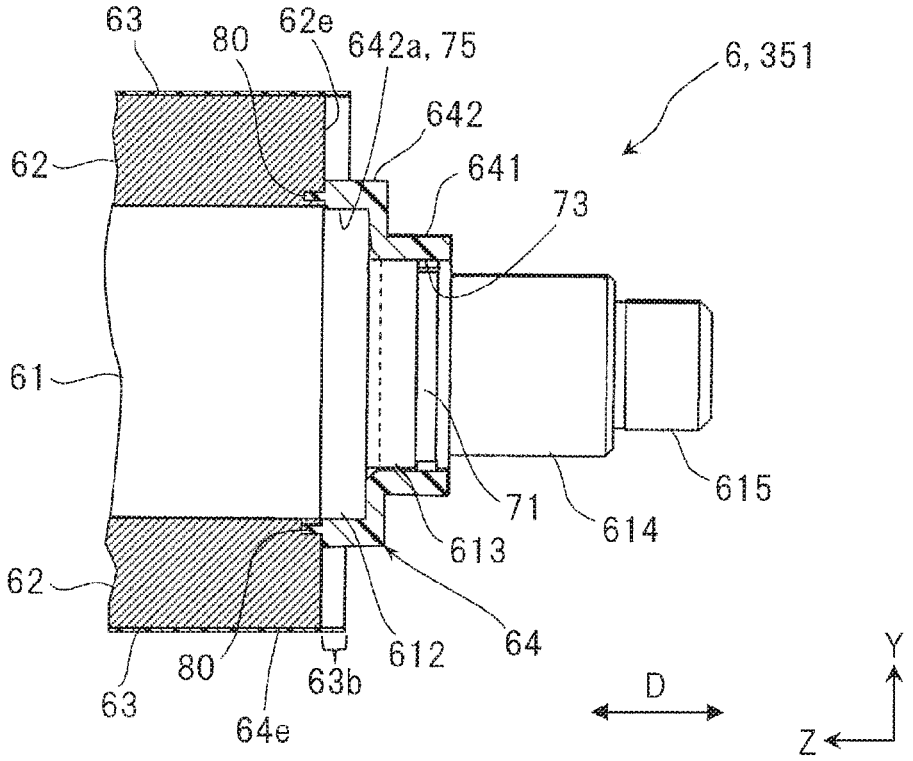
FIG. 9A is a partial cross-sectional view illustrating a state where the annular member is attached at one end of the second transfer roll of FIGS. 5A and 5B.
Figure 9B:
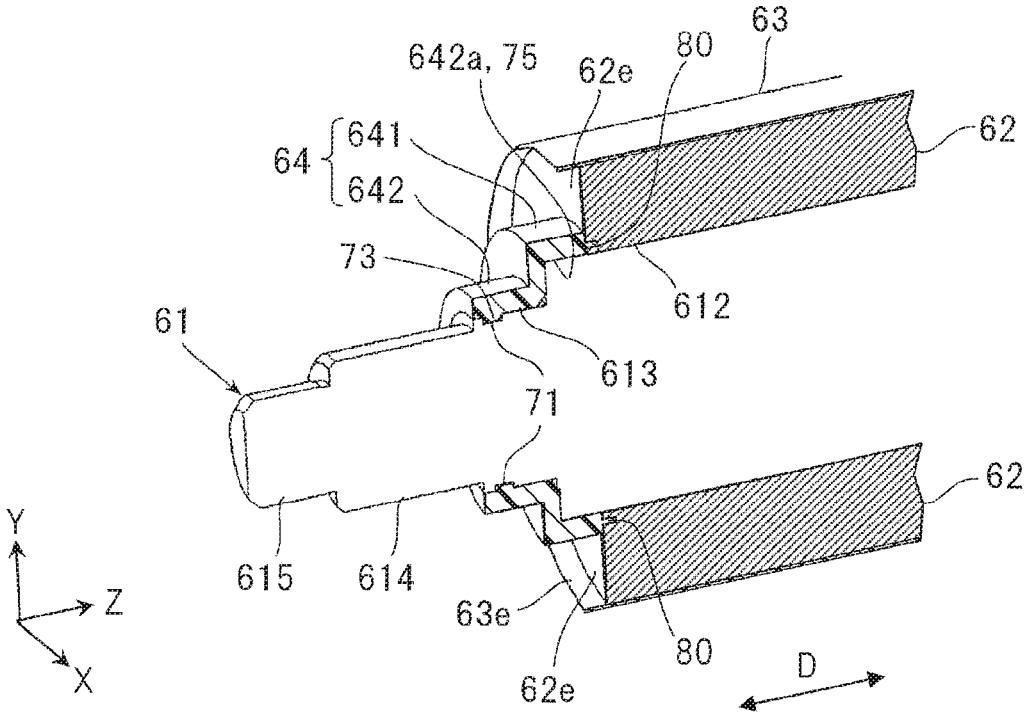
FIG. 9B is a vertical cross-sectional view of one end of the second transfer roll of FIGS. 5A and 5B.

As illustrated in FIGS. 7A and 7B, the protruding part 80 is provided as a protruding part having a shape continuous in an annular manner on the annular end surface 64*e* of the annular member 64. Furthermore, as illustrated in FIGS. 9A and 9B, the protruding part 80 is provided so as not to make contact with the shaft 61 when the annular member 64 is attached. In the first exemplary embodiment, the protruding part 80 is provided at an almost middle position in a thickness direction on the end surface 64*e* of the large-diameter part 642, as illustrated in FIGS. 7A, 7B, and 8B and other drawings.

The roll 6 that serves as the second transfer roll 351 is, for example, assembled in the following order.

First, the annular member 64 is attached to the large-diameter part 612 and the small-diameter part 613 of the shaft 61 in the second transfer roll 351. This second transfer roll 351 is a roll configured such that the elastic layer 62 and the surface layer 63 are provided in this order within a predetermined range of the large-diameter part 612 of the shaft 61.

The small-diameter part 641 of the annular member 64 is attached to the small-diameter part 613 of the shaft 61 at an almost same time as the large-diameter part 642 of the annular member 64 is press-fitted to the large-diameter part 612 of the shaft 61.

In particular, in a case where the small-diameter part 641 of the annular member 64 is attached to the small-diameter part 613 of the shaft 61, the fixed parts 73 that are three protrusions on the inner circumferential surface 641*a* of the small-diameter part 641 of the annular member 64 are fitted into the continuous groove-shaped fixing part 71 provided on the small-diameter part 613 of the shaft 61 as illustrated in FIGS. 9A and 9B.

This prevents the three fixed parts 73 provided on the annular member 64 from moving in the shaft direction D since the fixed parts 73 make contact with left and right groove side wall surfaces of the groove-shaped fixing part 71 of the shaft 61 in the shaft direction D. As a result, the annular member 64 is fixed to the shaft 61 without being displaced in the shaft direction D, thereby keeping a state where the annular member 64 is in contact with the end surface 62*e* of the elastic layer 62.

When the large-diameter part 642 of the annular member 64 is attached to the large-diameter part 612 of the shaft 61, the end surface 64*e* of the large-diameter part 642 is in contact with the end surface 62*e* of the elastic layer 62 in a state where the protruding part 80 cuts into the end surface 62*e* of the elastic layer 62 as illustrated in FIGS. 9A and 9B. The protruding part 80 cuts into the end surface 62*e* of the elastic layer 62 by elastically deforming a part of the end surface 62*e* of the elastic layer 62 inward along the shaft direction D.

As a result, a gap is harder to occur between the end surface 64*e* of the annular member 64 and the end surface 62*e* of the elastic layer 62 since not only the end surface 64*e* of the large-diameter part 642 of the annular member 64 is in contact with the end surface 62*e* of the elastic layer 62, but also a state where the end surface 64*e* of the annular member 64 is press-fitted to the end surface 62*e* of the elastic layer 62 is kept as compared with a case where the protruding part 80 is not provided on the annular member 64.

The protruding part 80 having a shape continuous in an annular manner is provided on the end surface 64*e* of the large-diameter part 642 of the annular member 64. Accordingly, the protruding part 80 cuts into the annular end surface 62*e* of the elastic layer 62 continuously without interruption, and therefore a gap is further harder to occur between the annular member 64 and the end surface 62*e* of the elastic layer 62.

Furthermore, the protruding part 80 is provided so as not to make contact with the shaft 61 when the annular member 64 is attached. Therefore, the elastic layer 62 is hard to peel off from a circumferential surface of the shaft 61 (the large-diameter part 612) even in a case where the elastic layer 62 is elastically deformed when the protruding part 80 cuts into the elastic layer 62, and there is no risk of occurrence of a new gap between the end surface 64*e* of the large-diameter part 642 of the annular member 64 and the outer circumferential surface of the shaft 61.

Furthermore, when the large-diameter part 642 of the annular member 64 is attached to the large-diameter part 612 of the shaft 61, the large-diameter part 642 is attached in a press-fitted state since the inner circumferential surface 642*a* of the large-diameter part 642 is configured as the press-fitted part 75.

As a result, the annular member 64 is harder to move in the shaft direction D of the shaft 61. This keeps a state where the annular member 64 is firmly attached in the shaft direction D in cooperation with the effect of preventing movement in the shaft direction D by engagement of the fixing part 71 and the fixed part 73. Furthermore, the annular member 64 is harder to move in the circumferential direction of the shaft 61, and therefore a state where the annular member 64 is firmly attached is kept.

Next, as illustrated in FIGS. 4A and 4B, in the second transfer roll 351, the holder 65 having a shaft bearing is attached to one end 61*a* of the shaft 61, and then the cover 67 is attached so as to cover an almost whole part of the holder 65 from an outer side. Furthermore, in the second transfer roll 351, the two-step gear 66 is attached to the other end 61*b*, and then the holder 65 is attached so as to be inserted into an inner side of the outer gear of the two-step gear 66. This completes the second transfer roll 351 as the roll 6 having the appearance illustrated in FIGS. 4A and 4B.

Furthermore, the completed second transfer roll 351 is attached to the attachment part in the second transfer device 35 of the image forming apparatus 1. When the second transfer roll 351 is rightly set at the second transfer position in the image forming apparatus 1, the shaft 61 becomes electrically conductive with the power feeding device 15.

In a case where the roll 6 that serves as the second transfer roll 351 is used for a certain period (e.g., 100 hours or longer) in a second transfer step by supplying a voltage for second transfer of approximately 5 kV to 7 kV to the roll 6 from the power feeding device 15, it has been confirmed that occurrence of discharge through a gap between the annular member 64 and the elastic layer 62 is suppressed as compared with a case where the fixing part 71 is not provided on the shaft 61 and the fixed part 73 is not provided on the annular member 64.

Furthermore, when this second transfer roll 351 is inspected, presence of a gap is not confirmed between the annular member 64 and the end surface 62*e* of the elastic layer 62 as illustrated in FIG. 9A. In the second transfer roll 351, both ends of the surface layer 63 have the projecting part 63*b* projecting to a side outside the end surface 62*e* of the elastic layer 62. With this configuration, discharge caused due to a gap between the annular member 64 and the end surface 62*e* of the elastic layer 62 is harder to occur.

In the image forming apparatus 1 in which the second transfer roll 351 that the roll 6 is applied to the second transfer device 35, occurrence of discharge through a gap that occurs between the annular member 64 and the elastic layer 62 due to a factor such as passage of time in the second transfer roll 351 is suppressed, and occurrence of a secondary failure caused by the discharge is also suppressed. The secondary failure is a trouble such as ignition of a foaming material such as the elastic layer 62 in the second transfer roll 351.

Second Exemplary Embodiment

Figure 10A:
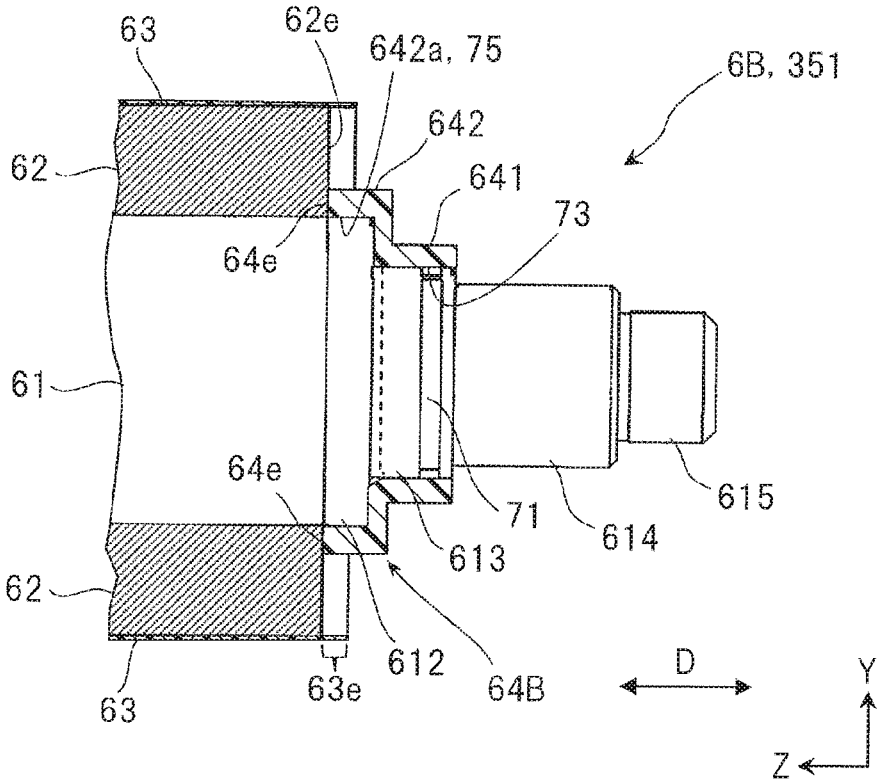
Figure 10A:
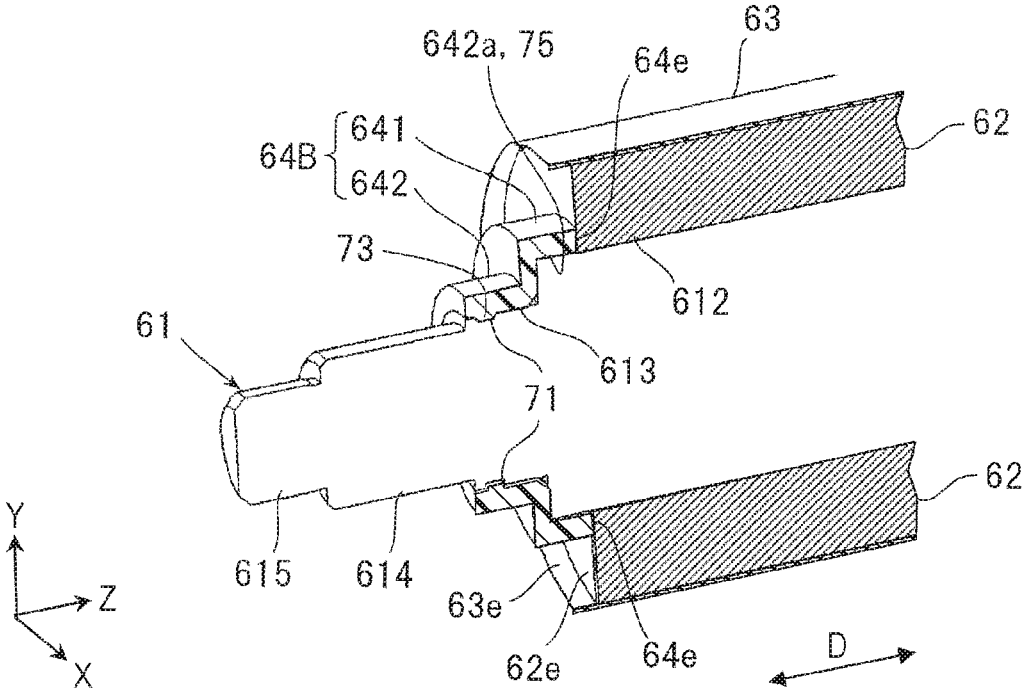
Figure 11A:
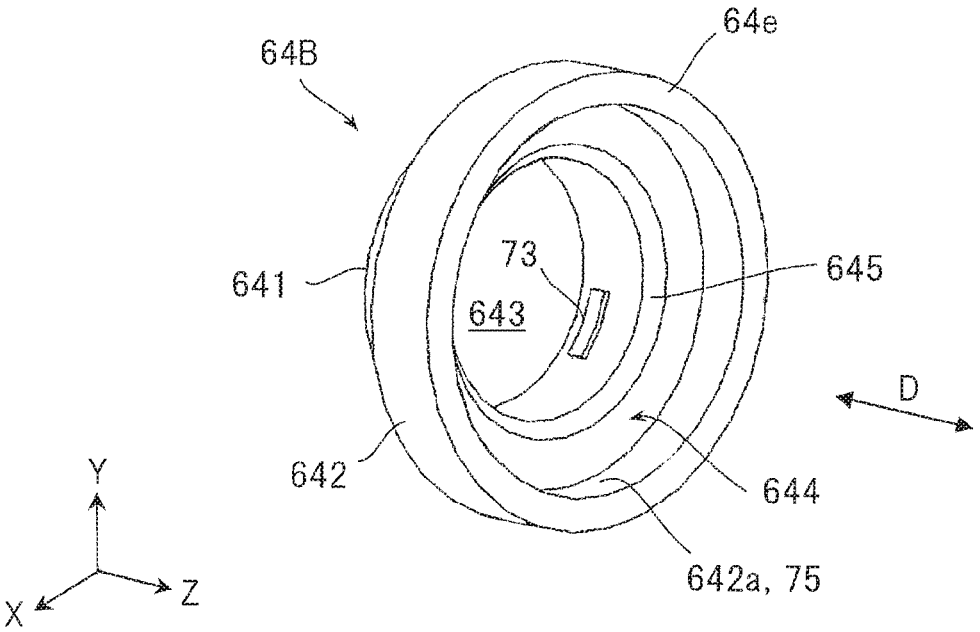
FIGS. 11A and 11B are schematic views illustrating states obtained when an annular member in the second transfer roll of FIGS. 10A and 10B is viewed from different directions.
Figure 11B:
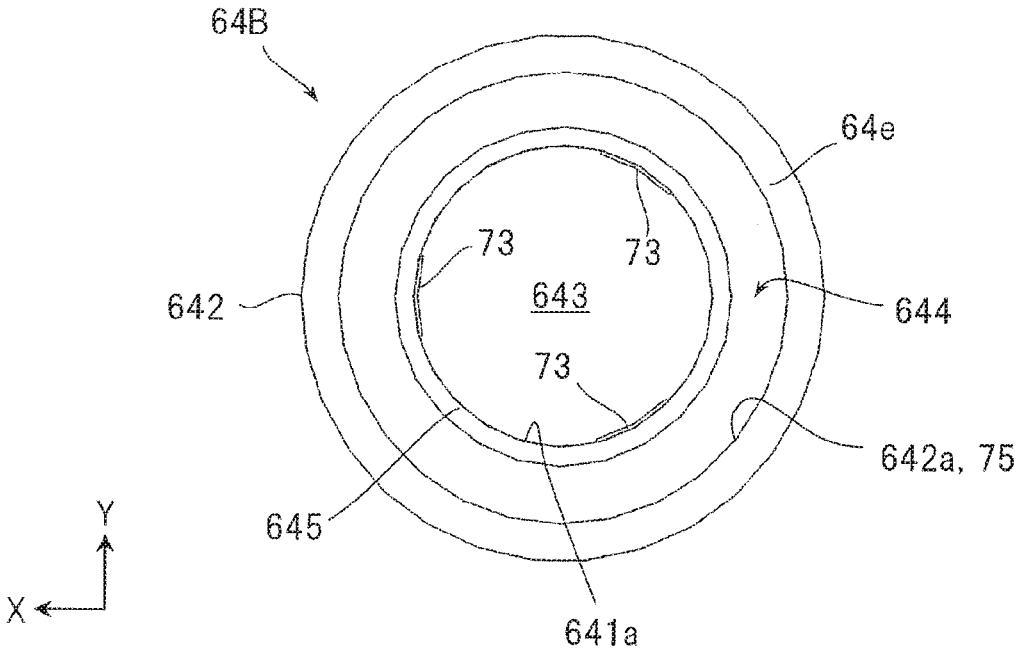

FIGS. 10A and 10B illustrate a roll 6B that serves as a second transfer roll 351 according to a second exemplary embodiment.

As illustrated in FIGS. 10A, 10B, 11A, and 11B, the roll 6B that serves as the second transfer roll 351 according to the second exemplary embodiment has a configuration identical to the roll 6 according to the first exemplary embodiment except for that an annular member 64B on which a protruding part 80 is not provided is applied as an annular member 64.

In the second transfer roll 351 that is the roll 6B, the annular member 64B is attached to a shaft 61 (a large-diameter part 612 and a small-diameter part 613) in a similar manner except for that when the annular member 64B is attached to the shaft 61, an end surface 64*e* of a large-diameter part 642 of the annular member 64B is in surface contact with an end surface 62*e* of an elastic layer 62 and the protruding part 80 does not cut into the end surface 62*e* of the elastic layer 62 unlike the annular member 64 (see FIGS. 9A and 9B and other drawings) according to the first exemplary embodiment.

That is, a small-diameter part 641 of the annular member 64B is attached to the small-diameter part 613 of the shaft 61 at a same time as a large-diameter part 642 of the annular member 64B is press-fitted to the large-diameter part 612 of the shaft 61.

In particular, when the small-diameter part 641 of the annular member 64B is attached to the small-diameter part 613 of the shaft 61, fixed parts 73 that are three protrusions on an inner circumferential surface 641*a* of the small-diameter part 641 of the annular member 64B are fitted into a fixing part 71 having a continuous groove shape on the small-diameter part 613 of the shaft 61 as illustrated in FIGS. 10A and 10B.

When the large-diameter part 642 of the annular member 64B is attached to the large-diameter part 612 of the shaft 61, the large-diameter part 642 is attached in a state where a press-fitted part 75 of an inner circumferential surface 642*a* of the large-diameter part 642 is press-fitted, as illustrated in FIGS. 10A and 10B.

In the second transfer roll 351 that is the roll 6B, occurrence of discharge through a gap between the annular member 64B and the elastic layer 62 is suppressed as compared with a case where the fixing part 71 is not provided on the shaft 61 and the fixed part 73 is not provided on the annular member 64B, almost similarly to the case of the roll 6 according to the first exemplary embodiment.

Figure 16A:
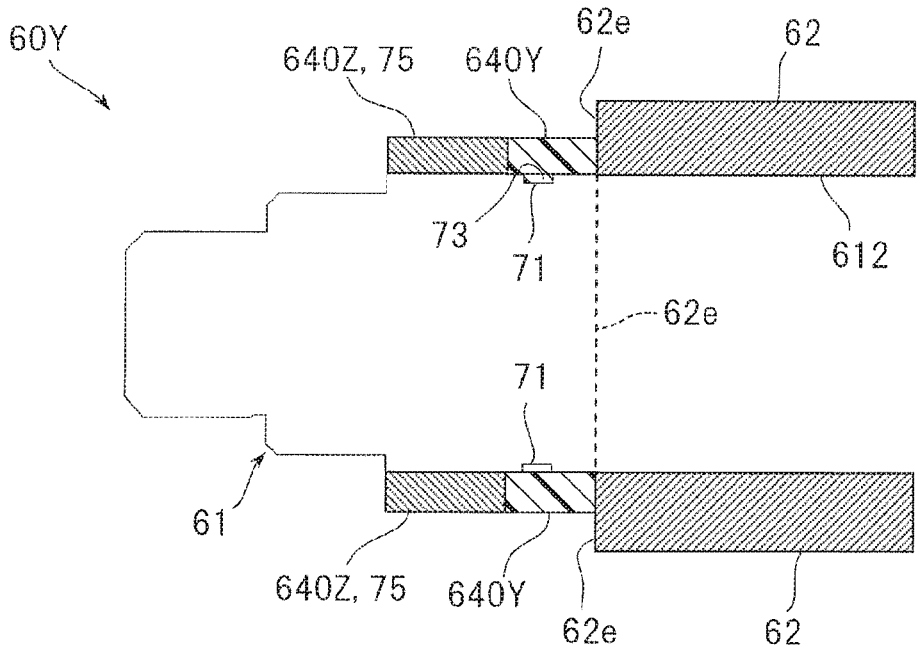
FIGS. 16A and 16B are schematic cross-sectional views illustrating a configuration of an annular member in a second transfer roll according to a second comparative example and a state during occurrence of discharge.

For reference, it has been confirmed that the following trouble occurs, for example, in a case where a roll 60Y according to a second comparative example is applied as the second transfer roll 351. As illustrated in FIG. 16A, the roll 60Y is configured such that an annular member for comparison divided into a first annular member 640Y having an annular shape on which the fixed parts 73 are provided and a second annular member 640Z having an annular shape configured as the press-fitted part 75 is used instead of the annular member 64B and this annular member is attached to an end of the shaft 61 so that the first annular member 640Y is in contact with the end surface 62*e* of the elastic layer 62 and the second annular member 640Z is in contact with the first annular member 640Y.

That is, in a case where the roll 60Y according to the second comparative example is used as the second transfer roll 351 to which a voltage for second transfer of approximately 5 kV to 7 kV is supplied, discharge sometimes occurs after elapse of a certain period (e.g., 100 hours or longer).

Figure 16B:
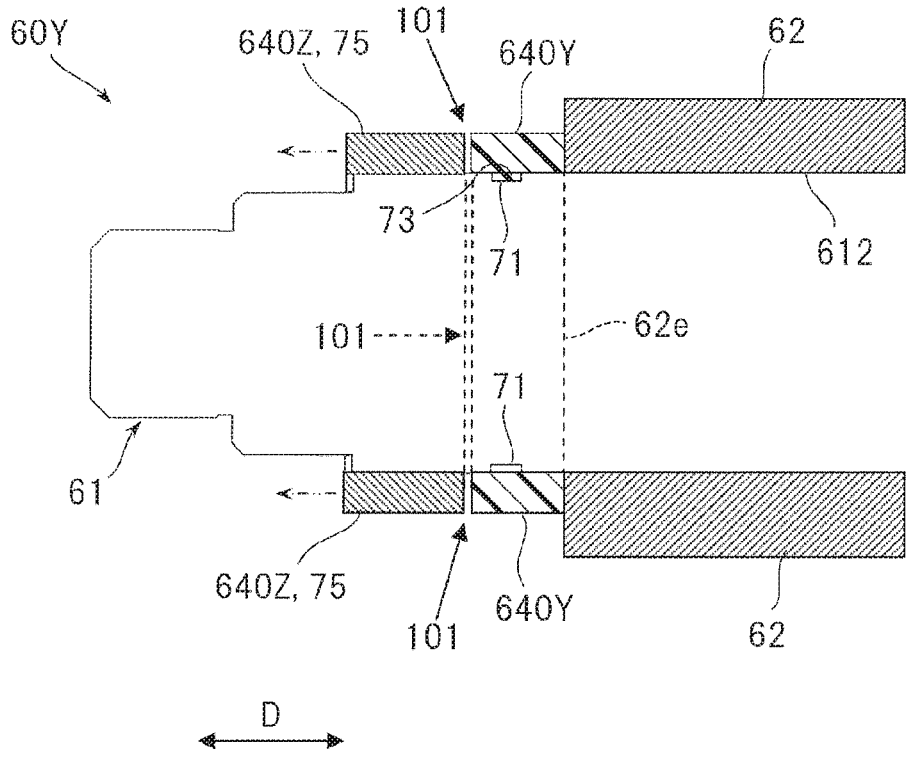

As a result of examination of the roll 60Y that caused the discharge, it has been confirmed that a small gap 101 reaching the shaft 61 is present between the first annular member 640Y and the second annular member 640Z as illustrated in FIG. 16B. This gap 101 is considered to have occurred because the second annular member 640Z is slightly deviated in the shaft direction D away from the first annular member 640Y as illustrated in FIG. 16B.

In the roll 60Y, no gap is present between the first annular member 640Y and the end surface 62*e* of the elastic layer 62.

Third Exemplary Embodiment

Figure 12A:
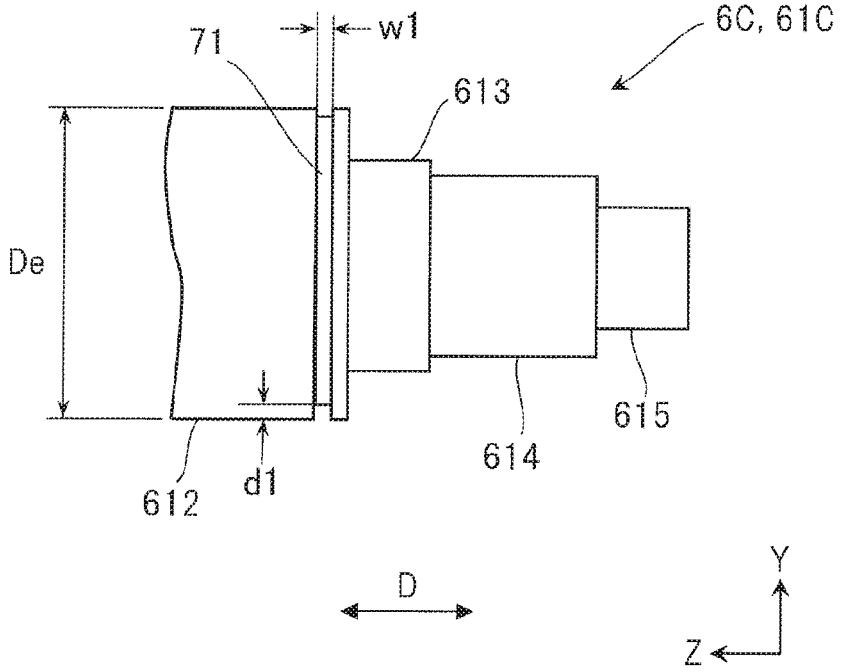
FIGS. 12A and 12B illustrate a second transfer roll according to a third exemplary embodiment.
Figure 12B:
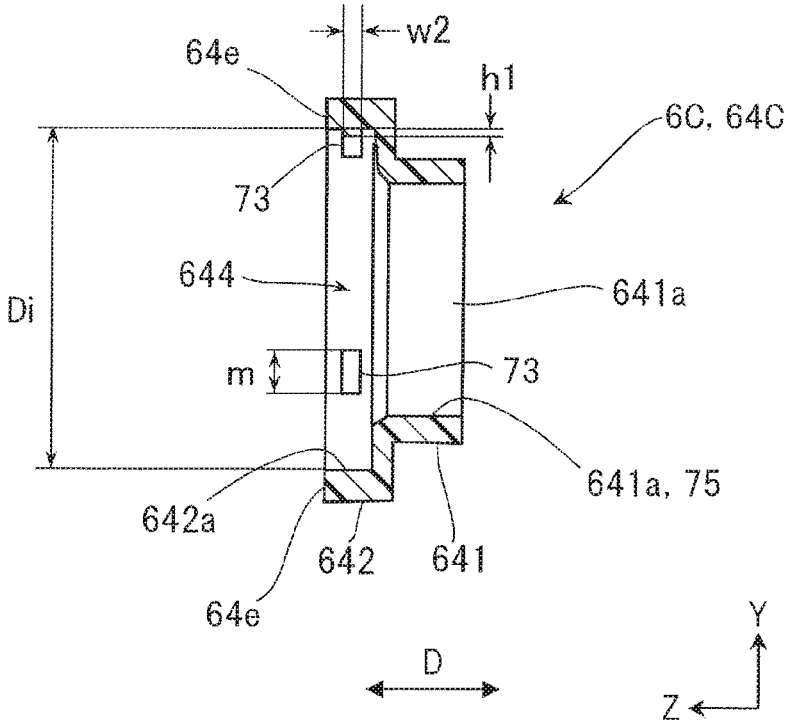

FIGS. 12A and 12B illustrate a part of a roll 6C that serves as a second transfer roll 351 according to a third exemplary embodiment.

As illustrated in FIGS. 12A and 12B, the roll 6C according to the third exemplary embodiment has a configuration identical to the roll 6B according to the second exemplary embodiment except for that a fixing part 71 is provided on a large-diameter part 612 of a shaft 61C and fixed parts 73 are provided on an inner circumferential surface 642*a* of a large-diameter part 642 of an annular member 64C and that a small-diameter part 641 is configured as a press-fitted part 75.

As illustrated in FIG. 12A, the fixing part 71 provided on the large-diameter part 612 of the shaft 61C is a groove-shaped fixing part having an almost similar configuration (FIG. 8A) to the fixing part 71 according to the first exemplary embodiment. The fixed parts 73 provided on the inner circumferential surface 642*a* of the large-diameter part 642 of the annular member 64C are three fixed parts having an almost similar configuration (FIG. 8B) to the fixed parts 73 according to the first exemplary embodiment, as illustrated in FIG. 12B.

Furthermore, an inner circumferential surface 641*a* of the small-diameter part 641 of the annular member 64C is configured as the press-fitted part 75 that is press-fitted to a small-diameter part 613 of the shaft 61C.

The small-diameter part 641 of the annular member 64C of the roll 6C is press-fitted to the small-diameter part 613 of the shaft 61C at an almost same time as the large-diameter part 642 of the annular member 64C of the roll 6C is attached to the large-diameter part 612 of the shaft 61C.

In particular, when the large-diameter part 642 of the annular member 64C is attached to the large-diameter part 612 of the shaft 61C, the three fixed parts 73 on the inner circumferential surface 642*a* of the large-diameter part 642 of the annular member 64C are fitted into the fixing part 71 having a continuous groove shape on the large-diameter part 612 of the shaft 61C.

When the small-diameter part 641 of the annular member 64C is attached to the small-diameter part 613 of the shaft 61C, the small-diameter part 641 is attached in a state where the press-fitted part 75 on the inner circumferential surface 641*a* of the small-diameter part 641 is press-fitted.

In the second transfer roll 351 that is the roll 6C, occurrence of discharge through a gap that occurs between the annular member 64C and the elastic layer 62 is suppressed as compared with a case where the fixing part 71 is not provided on the shaft 61C and the fixed parts 73 are not provided on the annular member 64C, almost similarly to the case of the roll 6B according to the second exemplary embodiment.

Fourth Exemplary Embodiment

Figure 13:
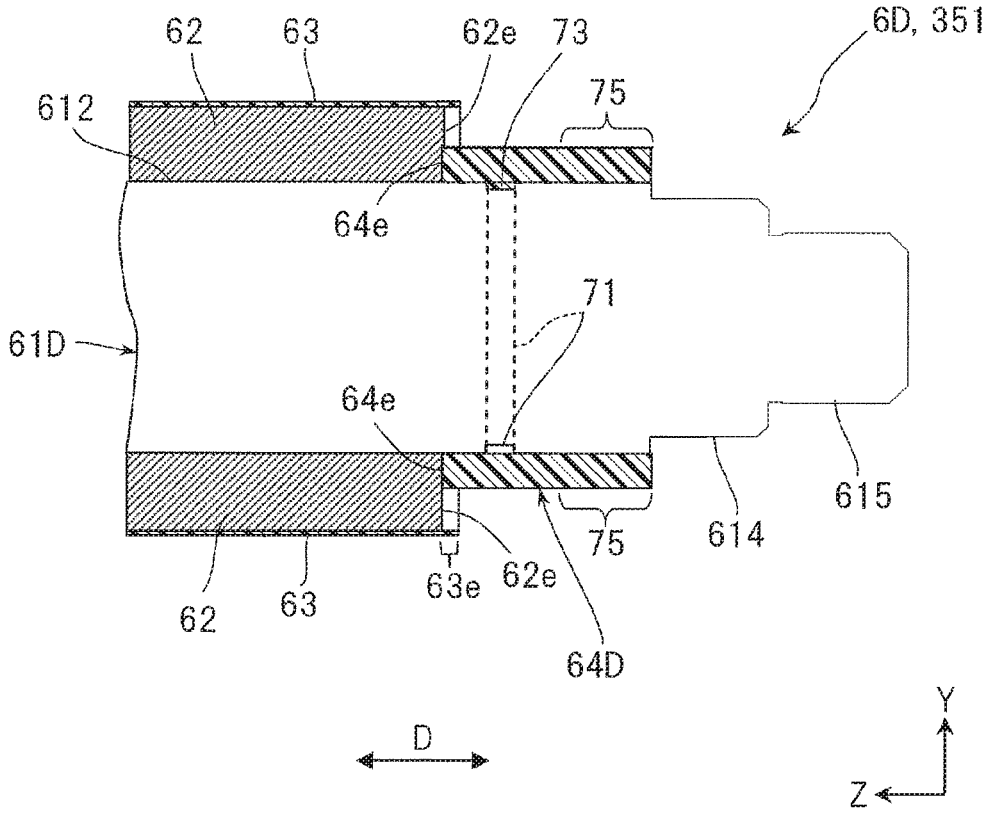
FIG. 13 is a cross-sectional view illustrating a configuration of one end of a second transfer roll according to a fourth exemplary embodiment.

FIG. 13 illustrates a part of a roll 6D that serves as a second transfer roll 351 according to a fourth exemplary embodiment.

Figure 14A:
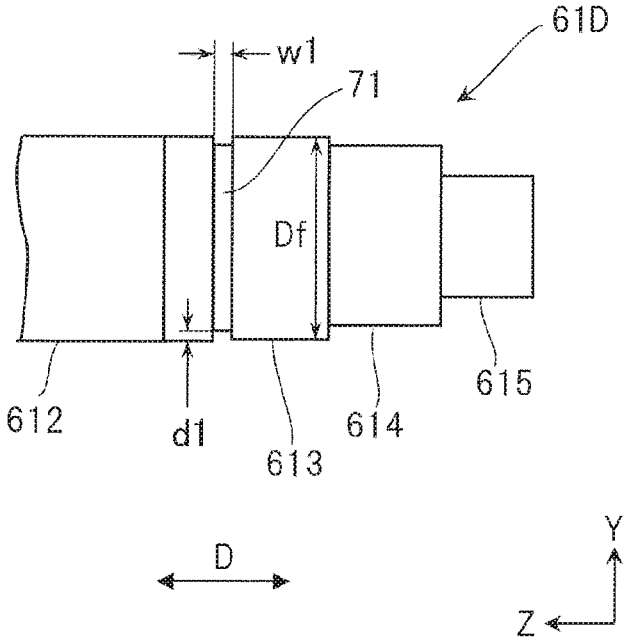
FIG. 14A is a schematic view illustrating one end of a shaft in the second transfer roll of FIG. 13.
Figure 14B:
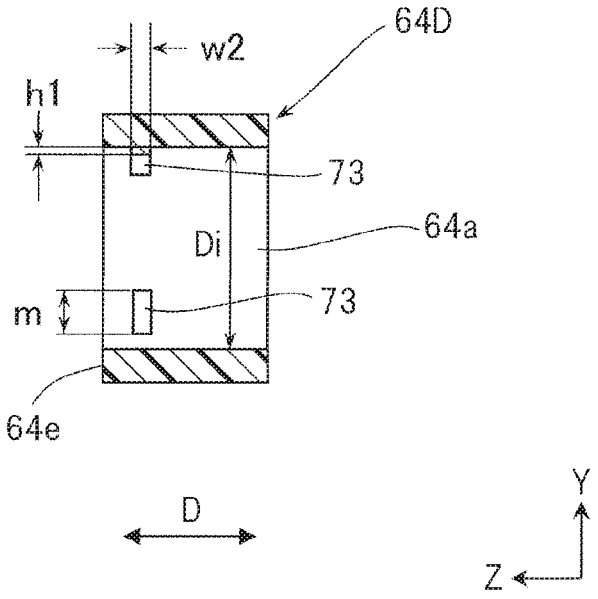
FIG. 14B is a schematic cross-sectional view illustrating an annular member in the second transfer roll of FIG. 13.

As illustrated in FIGS. 13, 14A, and 14B, the roll 6D according to the fourth exemplary embodiment has a configuration identical to the roll 6C according to the third exemplary embodiment except for that a shaft 61D configured such that a small-diameter part 613 on which a groove-shaped fixing part 71 is provided is elongated is applied, a cylindrical annular member 64D that does not have a two-step shape is applied, a fixed part 73 is provided in a part on a side close to an end surface 64*e* of the annular member 64D that makes contact with an elastic layer 62, and a part on a side far from the end surface 64*e* is configured as a press-fitted part 75.

The press-fitted part 75 is obtained, for example, by making an inner diameter Di of an inner circumferential surface 64*a* of the annular member 64C same as an external form Df of the small-diameter part 613 of the shaft 61D.

The annular member 64D of the roll 6D is attached to the small-diameter part 613 of the shaft 61D from a side where an end of the end surface 64*e* that makes contact with the elastic layer 62 is present.

In particular, when the part on the side close to the end surface 64*e* of the annular member 64D is attached to the small-diameter part 613 of the shaft 61D, three fixed parts 73 on the inner circumferential surface 64*a* of the annular member 64D are fitted into a fixing part 71 having a continuous groove shape provided on the small-diameter part 613 of the shaft 61D.

When the part on the side far from the end surface 64*e* of the annular member 64D is attached to the small-diameter part 613 of the shaft 61D, this part is attached in a state where the press-fitted part 75 on the inner circumferential surface 64*a* of the annular member 64D is press-fitted.

In the second transfer roll 351 that is the roll 6D, occurrence of discharge through a gap that occurs between the annular member 64D and the elastic layer 62 is suppressed as compared with a case where the fixing part 71 is not provided on the shaft 61D and the fixed parts 73 are not provided on the annular member 64D, almost similarly to the case of the roll 6C according to the third exemplary embodiment. That is, in a case where the annular member 64D having an integral structure is applied, occurrence of a gap 101 (FIG. 16B) is suppressed unlike the roll 60Y according to the second comparative example.

Modifications

The present disclosure is not limited to the contents illustrated in the first through fourth exemplary embodiments and can be changed in various ways without departing from the spirit of the disclosure described in the claims. Therefore, the present disclosure encompasses the modifications illustrated below.

In the annular members 64, 64B, and 64D according to the first, second, and fourth exemplary embodiments, the press-fitted part 75 may be omitted.

In a case where the press-fitted part 75 is omitted, it is desirable to employ a configuration for preventing movement (rotation) in a circumferential direction on the shaft 61 or 61D to which the annular member 64, 64B, or 64D is attached. Examples of the configuration for preventing the movement in the circumferential direction include a configuration in which the fixing part 71 has a shape (a shape that almost matches the fixed parts 73) that prevents movement in the circumferential direction of the fixed parts 73 and the configuration in which a stick-shaped member for stopping rotation is inserted into a groove along the shaft direction D provided both on the shaft 61 or 61D and the annular member 64, 64B, or 64D.

The roll 6 or the like according to the present disclosure may be configured such that the annular member 64, 64B, 64C, or 64D is attached to one of the ends 61*a* and 61*b* of the shaft 61 or the like. The roll 6 or the like according to the present disclosure may be configured such that the surface layer 63 is not provided. In a case where the surface layer 63 is provided, the projecting part 63*e* of the surface layer 63 may be omitted.

The roll 6 or the like according to the present disclosure is not limited to a case where the roll 6 or the like is applied to the second transfer roll 351 and can be applied as another roll in which a voltage that can cause discharge is supplied to the shaft 61. Examples of the other roll include a first transfer roll, a charging roller, a second transfer opposing roll, and a development roller provided with an elastic layer.

Furthermore, an image forming apparatus to which the roll 6 or the like according to the present disclosure is applied need just be an image forming apparatus to which the roll 6 or the like according to the present disclosure is applicable, and a form, a kind, an image formation method, and the like of the image forming apparatus are not limited in particular.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A roll comprising:

an electrically-conductive shaft;

an elastic layer provided on the shaft; and a non-electrically-conductive annular unit that is attached to at least one of ends of the shaft that protrude from end surfaces of the elastic layer in a shaft direction while being in contact with the end surface of the elastic layer, wherein a fixing part that fixes an attachment position of the annular unit in the shaft direction is provided on a part of the ends of the shaft to which the annular unit is attached, wherein a fixed part fixed by the fixing part of the shaft is provided on a part of an inner circumferential surface of the annular unit in the shaft direction, and wherein the fixed part fits into the fixing part.

2. The roll according to claim 1, wherein a part other than the part of the inner circumferential surface of the annular unit on which the fixed part is provided is configured as a press-fitted part that is press-fitted to the end of the shaft.

3. The roll according to claim 2, wherein the fixing part is configured as a recess, and wherein the fixed part is configured as a raised part fitted into the recess.

4. The roll according to claim 1, wherein the part of the ends of the shaft to which the annular unit is attached is a stepped part constituted by a smaller diameter part and a larger-diameter part, wherein the annular unit is a two-step shaped member having a smaller diameter part and a larger-diameter part that are attached to the smaller diameter part and the larger-diameter part of the stepped part of the shaft, respectively, wherein the fixing part is provided on the smaller diameter part of the stepped part of the shaft, and wherein the fixed part is provided on an inner circumferential surface of the smaller diameter part of the annular unit.

5. The roll according to claim 4, wherein the larger-diameter part of the annular unit is configured as a press-fitted part that is press-fitted to the larger-diameter part of the shaft.

6. The roll according to claim 5, wherein the fixing part is configured as a recess, and wherein the fixed part is configured as a raised part fitted into the recess.

7. The roll according to claim 4, wherein the fixing part is configured as a recess, and wherein the fixed part is configured as a raised part fitted into the recess.

8. The roll according to claim 1, wherein the part of the ends of the shaft to which the annular unit is attached is a stepped part constituted by a smaller diameter part and a larger-diameter part, wherein the annular unit is a two-step shaped member having a smaller diameter part and a larger-diameter part that are attached to the smaller diameter part and the larger-diameter part of the stepped part of the shaft, respectively, wherein the fixing part is provided on the larger-diameter part of the stepped part of the shaft, and wherein the fixed part is provided on an inner circumferential surface of the larger-diameter part of the annular unit.

9. The roll according to claim 8, wherein the smaller diameter part of the annular unit is configured as a press-fitted part that is press-fitted to the smaller diameter part of the shaft.

10. The roll according to claim 9, wherein the fixing part is configured as a recess, and wherein the fixed part is configured as a raised part fitted into the recess.

11. The roll according to claim 8, wherein the fixing part is configured as a recess, and wherein the fixed part is configured as a raised part fitted into the recess.

12. The roll according to claim 1, wherein the fixing part is configured as a recess, and wherein the fixed part is configured as a raised part fitted into the recess.

13. The roll according to claim 1, wherein a protruding part that cuts into the end surface of the elastic layer is provided on an end surface of the annular unit that makes contact with the elastic layer.

14. The roll according to claim 1, wherein the fixing part comprises a recess.

15. The roll according to claim 1, wherein the fixed part comprises a protrusion.

16. An image forming apparatus comprising:

a roll having an electrically conductive shaft, an elastic layer provided on the shaft, and a non-electrically-conductive annular unit that is attached to one of ends of the shaft that protrude from end surfaces of the elastic layer in a shaft direction; and a power feeding unit that supplies a voltage to the shaft of the roll, wherein a fixing part that fixes an attachment position of the annular unit in the shaft direction is provided on a part of the ends of the shaft to which the annular unit is attached, wherein a fixed part fixed by the fixing part of the shaft is provided on a part of an inner circumferential surface of the annular unit in the shaft direction, and wherein the fixed part fits into the fixing part.

17. A roll comprising:

an electrically-conductive shaft;

an elastic layer provided on the shaft; and a non-electrically-conductive ring that is attached to at least one of ends of the shaft that protrude from end surfaces of the elastic layer in a shaft direction while being in contact with the end surface of the elastic layer, wherein a groove that fixes an attachment position of the ring in the shaft direction is provided on a part of the ends of the shaft to which the ring is attached, and wherein a protrusion that is fixed by the groove is provided on a part of an inner circumferential surface of the ring in the shaft direction.

18. A roll comprising:

an electrically-conductive shaft;

an elastic layer provided on the shaft; and a non-electrically-conductive annular unit that is attached to at least one of ends of the shaft that protrude from end surfaces of the elastic layer in a shaft direction while being in contact with the end surface of the elastic layer, wherein a fixing part that fixes an attachment position of the annular unit in the shaft direction is provided on a part of the ends of the shaft to which the annular unit is attached, wherein a fixed part fixed by the fixing part of the shaft is provided on a part of an inner circumferential surface of the annular unit in the shaft direction, and wherein a part other than the part of the inner circumferential surface of the annular unit on which the fixed part is provided is configured as a press-fitted part that is press-fitted to the end of the shaft.

19. A roll comprising:

an electrically-conductive shaft;

an elastic layer provided on the shaft; and a non-electrically-conductive annular unit that is attached to at least one of ends of the shaft that protrude from end surfaces of the elastic layer in a shaft direction while being in contact with the end surface of the elastic layer, wherein a fixing part that fixes an attachment position of the annular unit in the shaft direction is provided on a part of the ends of the shaft to which the annular unit is attached, wherein a fixed part fixed by the fixing part of the shaft is provided on a part of an inner circumferential surface of the annular unit in the shaft direction, and wherein the part of the ends of the shaft to which the annular unit is attached is a stepped part constituted by a smaller diameter part and a larger-diameter part.

20. A roll comprising:

an electrically-conductive shaft;

an elastic layer provided on the shaft; and a non-electrically-conductive annular unit that is attached to at least one of ends of the shaft that protrude from end surfaces of the elastic layer in a shaft direction while being in contact with the end surface of the elastic layer, wherein a fixing part that fixes an attachment position of the annular unit in the shaft direction is provided on a part of the ends of the shaft to which the annular unit is attached, wherein a fixed part fixed by the fixing part of the shaft is provided on a part of an inner circumferential surface of the annular unit in the shaft direction, wherein the fixing part is configured as a recess, and wherein the fixed part is configured as a raised part fitted into the recess.

* * * * *